US005692787A

United States Patent [19]

Young

[11] Patent Number: 5,692,787

[45] Date of Patent: Dec. 2, 1997

[54] DOOR BRACE

[76] Inventor: Thomas R. Young, RR2 Box 927, Dickenson, Tex. 77539

[21] Appl. No.: 492,910

[22] Filed: Jun. 20, 1995

[51] Int. Cl.[6] ..... F05C 17/44

[52] U.S. Cl. ..... 292/338; 292/DIG. 15

[58] Field of Search ..... 292/338, 339, 292/DIG. 15

[56] References Cited

U.S. PATENT DOCUMENTS

| | | | |
|---|---|---|---|
| 344,821 | 7/1886 | English | 292/338 |
| 1,473,834 | 11/1923 | Sasgen | 292/DIG. 15 |
| 1,698,944 | 1/1929 | De Foe | 292/338 |
| 1,721,257 | 7/1929 | Myers | 292/338 |
| 1,985,164 | 12/1934 | Green | 292/338 |
| 2,019,803 | 11/1935 | Tusher | 292/338 |
| 3,831,989 | 8/1974 | Gurzenda | 292/DIG. 15 |
| 4,456,291 | 6/1984 | Brogie | 292/338 |
| 4,607,870 | 8/1986 | Crisp | 292/DIG. 15 |
| 5,014,527 | 5/1991 | Traller | 292/338 |
| 5,040,835 | 8/1991 | Barker | 292/338 |
| 5,282,658 | 2/1994 | Reeves | 292/338 |

*Primary Examiner*—Rodney M. Lindsey
*Assistant Examiner*—Gary Estremsky
*Attorney, Agent, or Firm*—Wendy K. Buskop, Chamberlain, Hrdlicka, et al.

[57] ABSTRACT

This invention relates to a door locking device that attaches to a door and can be used and stored easily. This invention further relates to a device that provides more support for hollow core doors. The construction of the device provides a leg having a slot which is received by a pin between two brackets. This construction allows for ease in use and storage while securing a door in a closed position.

6 Claims, 4 Drawing Sheets

DOOR BRACE

BACKGROUND OF THE INVENTION

In one aspect this invention relates to a door bracing or locking device that attaches to a door and can be used and stored easily. In another aspect, this invention relates to a device that can be used with hollow core doors. In another aspect, the invention relates to a method for bracing a door.

Existing door locking devices are cumbersome to use and difficult to store. A door brace that attaches to a door and can be stored on the door would be very desirable.

Existing door braces are not will suited for use with hollow core doors. A door brace that provides extra support for hollow core doors would be very desirable.

Many types of door locking devices require drilling the door frame or floor for installation. A locking device which is easy to install would be much sought after.

OBJECTS OF THE INVENTION

It is an object of this invention to provide a door locking device that is permanently affixed to a door and easy to use and store.

It is another object of this invention to provide a door locking or bracing device that is suited for use with hollow core doors.

It is another object of this invention to provide a door locking or bracing device that is inexpensive and is easy to install.

SUMMARY OF THE INVENTION

In one embodiment of the present invention there is provided a bracing leg which is well suited for bracing a door. The apparatus comprises leg having a first end and a second end. The leg has a first end portion extending from the first end toward the second end and a second end portion extending from the second end toward the first end. The leg has a longitudinal axis. The first end portion of the leg defines a longitudinally elongated, transverse slot and the slot is C-shaped. The C-shaped slot permits the leg to be permanently mounted to the door and stored on a lower portion of the door.

In another embodiment of the invention, there is provided an apparatus for bracing a door. The apparatus comprises a leg as described above and a base plate. The base plate has a top face and a bottom face. The base plate forms a first bracket plate and a second bracket plate extending from the top face generally normal to the base plate. The first bracket plate and the second bracket plate are spaced apart and positioned generally parallel to each other in a side by side relationship. A pin is attached to and positioned between the first bracket plate and the second bracket plate in a plane parallel to the base plate. The pin extends through the slot. This type of device can be permanently attached to the door and stored easily. The base plate provides sufficient support so that this device can be used effectively with hollow core doors.

In use, bottom face of the base plate is positioned adjacent to the door and attached thereto. The first bracket plate and the second bracket plate are positioned in a plane parallel to the longitudinal axis of the door. The leg is closely received by the first bracket plate and the second bracket plate and pivotally attached between the first bracket plate and the second bracket plate. The leg is movable from a first position for storage to a second position for bracing the door.

In another embodiment of the invention there is provided a method for using a door locking device. The method comprises providing a leg, a base plate, a door, and a floor. The leg and base plate can be as previously described. The floor is positioned in a plane generally normal to the door. The base plate is mounted to the door so that when the pin is positioned in the second end of the slot, the leg is in a first position generally parallel to the door. When the pin is positioned in the first end of the slot, the leg is in a second position extending away from the door and the second end of the leg is positioned on the floor so as to brace the door.

In another embodiment of the invention there is provided a bracket means. The bracket means comprises a first rectangular plate portion, a second rectangular plate portion, and a saddle shaped plate portion. The first rectangular plate portion has a first side edge and a second side edge. The second rectangular plate portion has a first side edge and a second side edge. The saddle shaped plate portion has a first U-shaped end and a second U-shaped end. The first U-shaped end connects the first side edge of the first plate portion to the first side edge of the second plate portion. The saddle shaped plate portion is positioned generally normal to the first plate portion and the second plate portion.

DETAILED DESCRIPTION OF THE PREFERRED EMBODIMENTS

Figure 1:
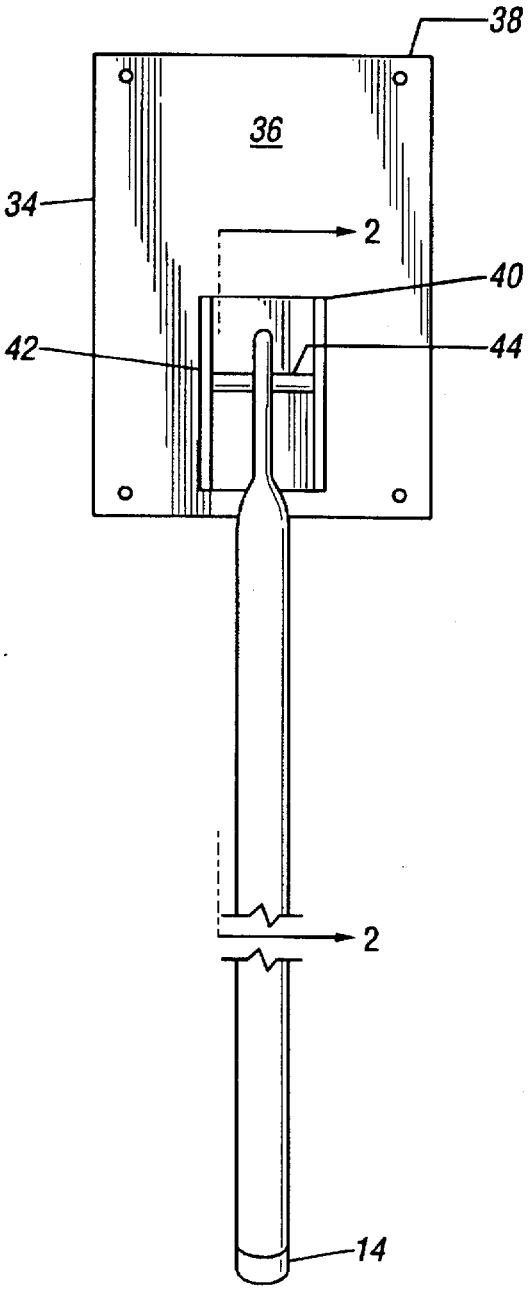
FIG. 1 is a frontal view of the device.

In the present invention there is provided an apparatus comprising a leg 2 having a first end 4 and a second end 6. The leg 2 has a first end portion 8 extending from the first end 4 toward the second end 6 and a second end portion 10 extending from the second end 6 toward the first end 4. The leg 2 has a longitudinal axis. The first end portion 8 has a cross section in a plane generally normal to the longitudinal axis. The cross section has a major axis and a minor axis. When the first end portion 8 is viewed in cross section it is preferably flattened. The first end portion 8 of the leg 2 defines a longitudinally elongated, transverse slot 12 and the slot 12 is C-shaped. Preferably, the slot 12 has an elongated portion 16 having a first end 18 and a second end 20. The slot 12 further has a first curved portion 22 adjacent to the first end 18 of the elongated portion 16 and a second curved portion 24 adjacent to the second end 20 of the elongated portion 16. The elongated portion 16 is positioned generally parallel to the longitudinal axis of the leg 2. The first curved portion 22 angles away from the elongated portion 16 and the second curved portion 24 angles away from the elongated portion 16. The first curved portion 22, the second curved portion 24 and the elongated portion 16 form a C-shape. Preferably, the second end portion 10 of the leg 2 is received by a rubber foot 14.

Figure 4:
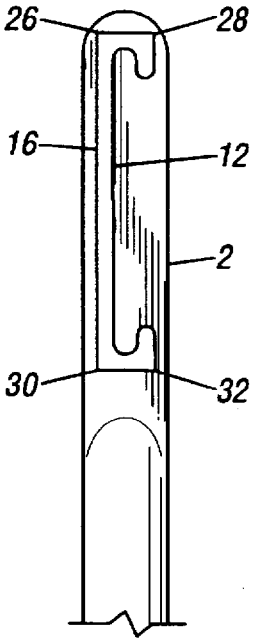
FIG. 4 is a side view of the leg showing another slot formation.

In another preferred embodiment, as best shown by FIG. 4, the first curved portion 22 of the slot 12 is connected to the elongated portion 16 at a first corner 26. The first curved portion 22 has a second corner 28 transversely spaced from the first corner 26. The second curved portion 24 of the slot 12 is connected to the elongated portion 16 at a third corner 30. The second curved portion 24 has a fourth corner 32 transversely spaced from the third corner 30. The slot 12 retains the shape of a C. Preferably, the corners form fight angles.

Figure 5:
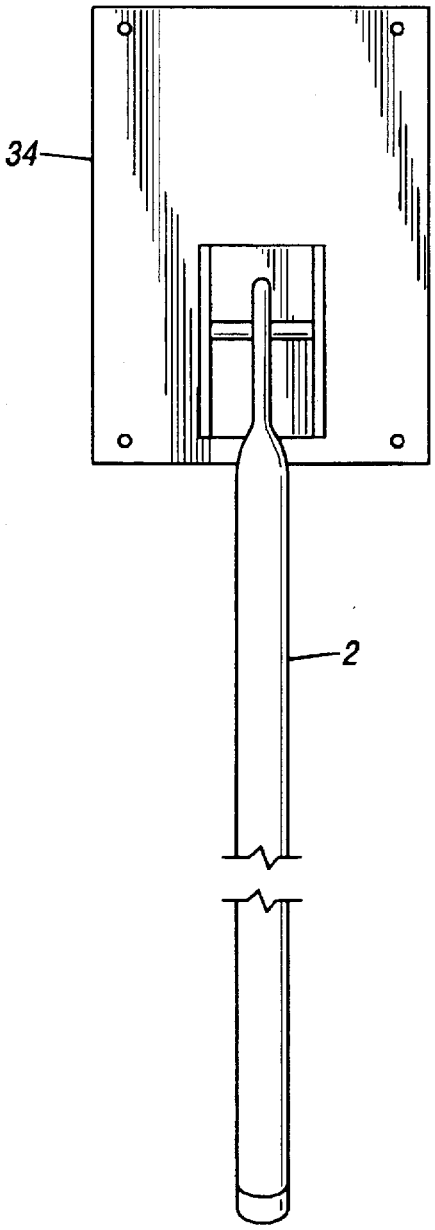
FIG. 5 is a frontal view of another embodiment of the device.

In another preferred embodiment, the leg 2 as previously described, further comprises a plate means 34 for mounting a bracket means 54 to a door 46. The plate means 34 has a top face 36 and a bottom face 38. The bracket means 54 forms a first bracket plate portion 40 and a second bracket plate portion 42 extending from the top face 36 generally normal to the plate means 34. The bracket plates are preferably formed from the plate means 34 in a stamping operation. The first bracket plate portion 40 and the second bracket plate portion 42 are spaced apart and positioned generally parallel to each other in a side by side relationship. Each bracket plate portion 40, 42 have an upper end 56 and a lower end 58. A pin 44 is attached to and positioned between the first bracket plate portion 40 and the second bracket plate portion 42 in a plane parallel to the plate means 34. The pin 44 extends through the slot 12. The pin is preferably welded to the bracket plates. The leg is pivotally attached between the first bracket plate portion 40 and the second bracket plate portion 42 by the pin 44. The leg 2 is preferably closely received by the first bracket plate portion 40 and the second bracket plate portion 42 as best shown in FIG. 5. Where the plates are spaced widely apart, bushings can be provided on the pin between the leg and the plate to reduce side play of the leg.

Figure 9:
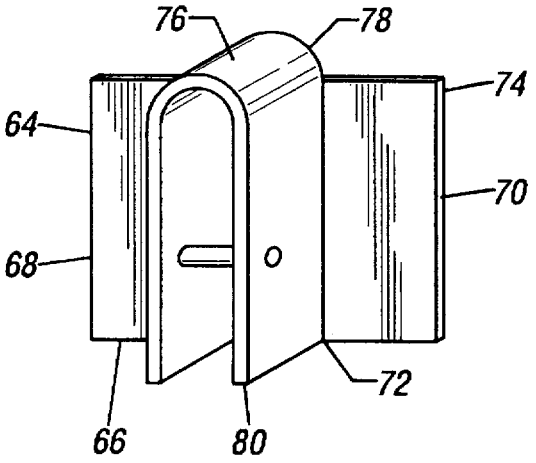
FIG. 9 is a side view of one embodiment of the bracket means.
Figure 10:
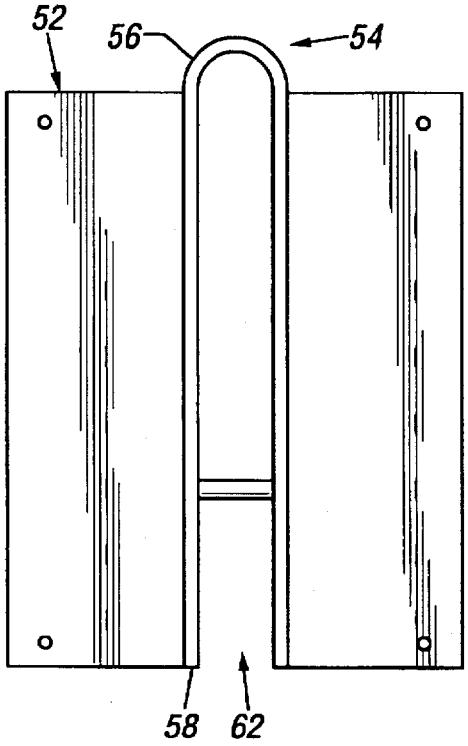
FIG. 10 is a front view of FIG. 9.

In a preferred embodiment of the invention, as shown in FIG. 9, the bracket means further comprises a U-shaped saddle portion 60 connecting the upper ends 56 and 58 of the first bracket portion 40 and the second bracket portion 42. The first bracket portion 40 and the second bracket portion 42 are positioned generally parallel to a longitudinal axis defined by the plate means 34. The first bracket portion 40 and the second bracket portion 42 define a channel 62 and the U-shaped saddle portion 60 opens into the channel 62.

In use, the plate means 34 is mounted to a door 46 having a longitudinal axis. The bottom face 38 of the plate means 34 is positioned adjacent to the door 46 and is attached thereto. The first bracket plate portion 40 and the second bracket plate portion 42 are positioned in a plane parallel to the longitudinal axis defined by the door 46. Additionally, there is provided a securing clip 48 sized to receive the second end 6 of the leg 2. The securing clip 48 is mounted on the door 46 below the plate means 34.

In another embodiment of the invention, there is provided a leg 2 as described above, a plate means 34, a bracket means 54, and a door 46. The plate means 34 has a top face 36 and a bottom face 38. The bracket means 54 protrudes from the plate means 34. The bracket means 54 comprises a first bracket plate portion 40 and a second bracket plate portion 42 extending from the top face 36 generally normal to the plate means 34. The first bracket plate portion 40 and the second bracket plate portion 42 are spaced apart and positioned generally parallel to each other in a side by side relationship. A pin 44 is attached to and positioned between the first bracket plate portion 40 and the second bracket plate portion 42 in a plane parallel to the plate means 34. The bottom face 38 of the plate means 34 is positioned adjacent to the door 46 and attached thereto. The first bracket plate portion 40 and the second bracket plate portion 42 are positioned in a plane parallel to the longitudinal axis of the door 46. The pin 44 extends through the slot 12. The leg 2 is closely received by the first bracket plate portion 40 and the second bracket plate portion 42 and pivotally attached between the first bracket plate portion 40 and the second bracket plate portion 42.

In another embodiment of the invention there is provided a bracket means 54. The bracket means 54 comprises a first rectangular plate portion 64, a second rectangular plate portion 70, and a saddle shaped plate portion 76. The first rectangular plate portion has a first side edge 66 and a second side edge 68. The second rectangular plate portion 70 has a first side edge 72 and a second side edge 74. The saddle shaped plate portion 76 has a first U-shaped end 78 and a second U-shaped end 80. The first U-shaped end 78 connects the first side edge 66 of the first plate portion to the first side edge 72 of the second plate portion 70. The saddle shaped plate portion 76 is positioned generally normal to the first plate portion 64 and the second plate portion 70.

Figure 2:
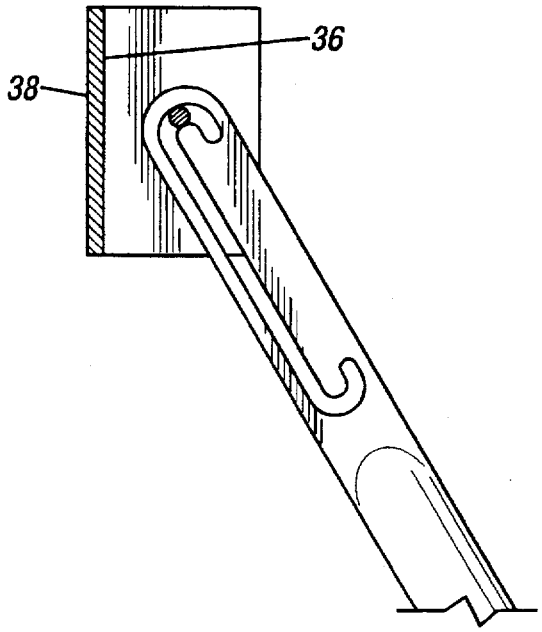
FIG. 2 is a cross-sectional view of the leg and the bracket plate taken along lines 2—2 of FIG. 1.
Figure 3:
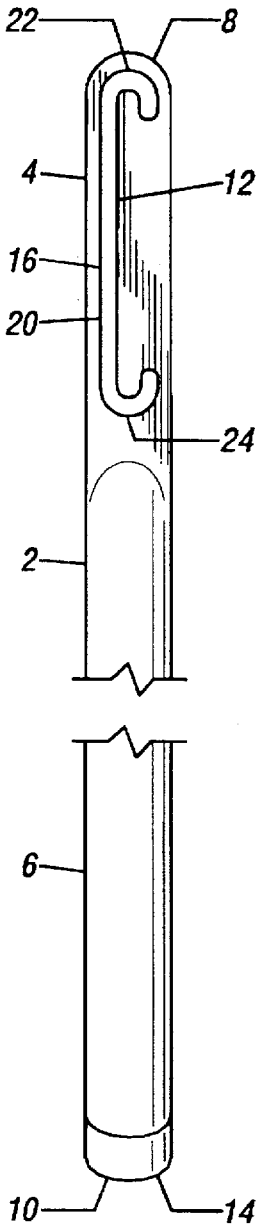
FIG. 3 is a side view of the leg.
Figure 6:
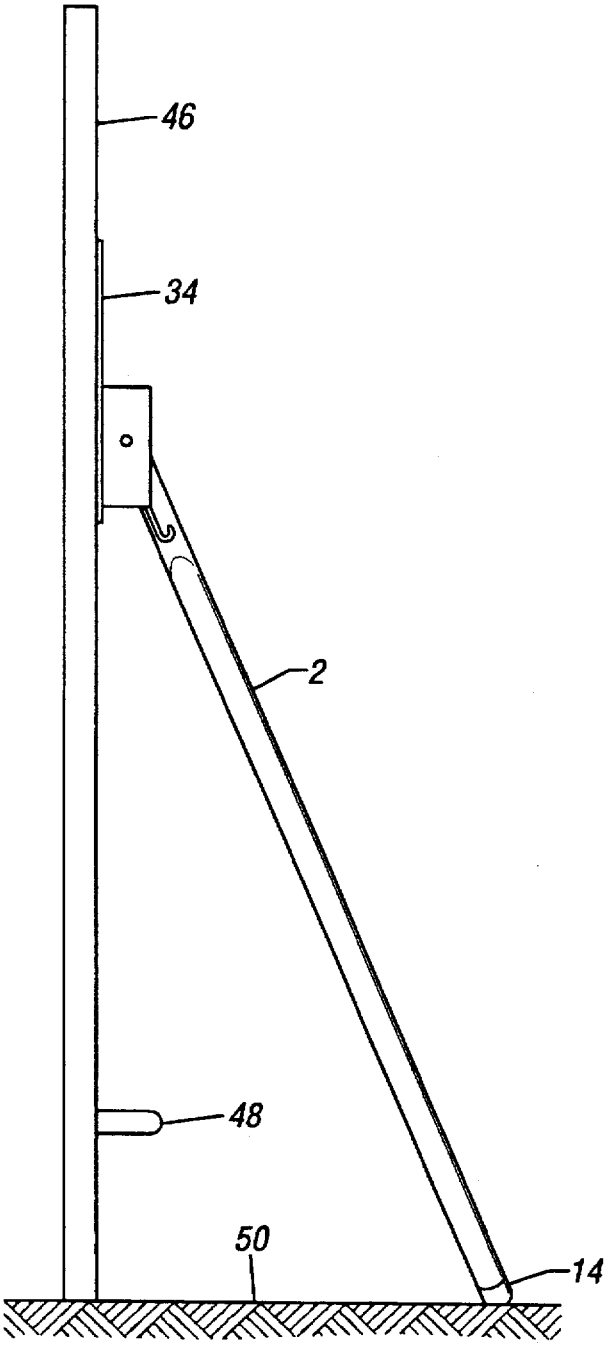
FIG. 6 is a side view showing the device in a "locked" position.
Figure 7:
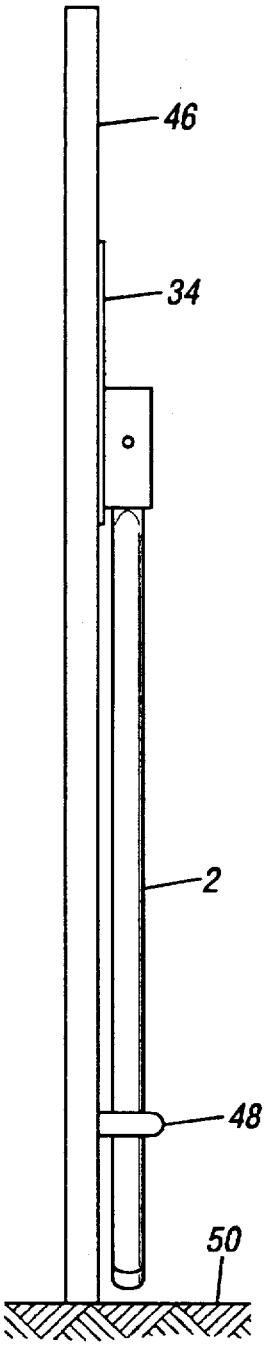
FIG. 7 is a side view showing the device in a stored position.
Figure 8:
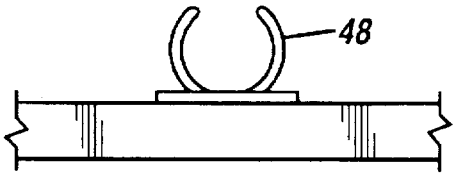
FIG. 8 is a top view of the securing clip.

In another embodiment of the invention there is provided a method for using a door locking device. The method comprises providing a leg 2, a plate means 34, a bracket means 54, a door 46, and a floor 50. The leg 2 has a first end 4 and a second end 6. The first end 4 defines a longitudinally elongated, transverse slot 12, and the slot 12 is C-shaped. The bracket means 54 comprises a first bracket plate portion 40 and a second bracket plate portion 42 and protrudes from the plate means 34. There is a pin 44 attached to and positioned between the first bracket plate portion 40 and the second bracket plate portion 42. The pin 44 extends through the slot 12. The floor 50 is positioned in a plane generally normal to the door 46. The plate means 34 is mounted to the door 46 so that when the pin 44 is positioned in the second end 20 of the slot 12, the leg 2 is in a first position generally parallel to the door 46, as shown in FIG. 7. When the pin 44 is positioned in the first end 18 of the slot 12, (see FIG. 2) the leg 2 is in a second position extending away from the door 46 and the second end 6 of the leg 2 is positioned on the floor 50 so as to brace the door 46, as shown in FIG. 6.

In another embodiment there is provided a method for bracing a door 46. The method comprises providing a door 46, and a leg 2. The leg 2 has a first end 4 and a second end 6. The leg 2 is mounted to the door 46. The first end 4 of the leg 2 is pivotally attached to the door 46 and the second end 6 contacts the floor 50. The first end 4 is slidably movable from a first position to a second position. The first end 4 is in the first position when the leg 2 is positioned at an angle to brace the door 46. The leg 2 is positioned at an angle to the door 46 so as to brace the door 46. The leg 2 is positioned adjacent to the door 46 when the leg 2 is in a second position.

I claim:

1. An apparatus comprising (a) leg having a first end and a second end, a first end portion extending from said first end toward said second end and a second end portion extending from said second end toward said first end, said leg having a longitudinal axis, wherein said first end portion defines a longitudinally elongated, transverse C-shaped slot, wherein the C-shaped slot has an elongated portion having a first end and a second end, a first curved portion adjacent to said first end of said elongated portion and a second curved portion adjacent to said second end of said elongated portion, wherein said elongated portion is positioned generally parallel to the longitudinal axis of said leg and the first curved portion and the second curved portion angle away from the elongated portion, wherein said first curved portion is connected to said elongated portion at a first corner and has a second corner transversely spaced from said first corner, and wherein said second curved portion is connected to said elongated portion at a third corner and has a fourth corner transversely spaced from said third corner;

(b) a plate means for mounting a bracket means to a door, said plate means having a top face and a bottom face, and a top edge and a bottom edge;

(c) a bracket means which protrudes from said top face of said plate means generally normal to said plate means, wherein said bracket means comprises a first bracket plate portion and a second bracket plate portion each having an upper end and a lower end being spaced apart and positioned generally parallel to each other in a side by side relationship; and (d) a pin attached to and positioned between said first bracket plate portion and said second bracket plate portion in a plane parallel to said plate means, wherein said pin extends through the slot and said leg is closely received by said first bracket plate portion and said second bracket plate portion and is pivotally attached to the pin, and wherein the first curved portion and the second curved portion of the C-shaped slot extend away from the elongated portion of the C-shaped slot and away from the plate.

2. An apparatus as in claim 1 wherein said bracket means further comprises a U-shaped saddle portion connecting the upper ends of the first bracket portion and the second bracket portion positioned generally parallel to a longitudinal axis defined by the plate means wherein the first bracket portion and the second bracket portion define a channel and said U-shaped saddle portion opens into said channel.

3. An apparatus as in claim 1 further comprising a door having a longitudinal axis wherein the bottom face of said plate means is positioned adjacent to said door and is fixedly attached thereto such that said bracket means is positioned in a plane parallel to the longitudinal axis defined by said door.

4. An apparatus as in claim 1 further comprising a securing clip sized to receive the second end of said leg, wherein said securing clip is mounted on said door below said plate means.

5. An apparatus as in claim 4, wherein said first end portion has a cross section in a plane generally normal to the longitudinal axis, said cross section having a major axis and a minor axis, wherein said first end portion when viewed in cross section is flattened, wherein said second end portion is received by a rubber foot.

6. An apparatus as in claim 4 further comprising a securing clip sized to receive the second end of said leg, wherein said securing clip is mounted on said door below said plate means.

* * * * *